US008175481B2

(12) United States Patent
Ozawa

(10) Patent No.: US 8,175,481 B2
(45) Date of Patent: May 8, 2012

(54) IMAGE-FORMING DEVICE FOR SUPPRESSING INTERNAL TEMPERATURE RISE WHEN SHEET-FEED ERROR OCCURS

(75) Inventor: Atsushi Ozawa, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 640 days.

(21) Appl. No.: 12/357,883

(22) Filed: Jan. 22, 2009

(65) Prior Publication Data

US 2009/0200734 A1 Aug. 13, 2009

(30) Foreign Application Priority Data

Feb. 8, 2008 (JP) ..... 2008-028543

(51) Int. Cl.
*G03G 15/20* (2006.01)

(52) U.S. Cl. ..... 399/69; 399/21; 399/70

(58) Field of Classification Search ..... 399/21, 399/69, 70

See application file for complete search history.

(56) References Cited

U.S. PATENT DOCUMENTS

| | | | | |
|---|---|---|---|---|
| 4,596,456 | A * | 6/1986 | Ide | 399/21 |
| 4,905,046 | A * | 2/1990 | Tsunoi et al. | |
| 2006/0198651 | A1 | 9/2006 | Tajima | |

FOREIGN PATENT DOCUMENTS

| | | |
|---|---|---|
| JP | 60-216358 | 10/1985 |
| JP | 04-276768 | 10/1992 |
| JP | 06-067481 | 3/1994 |
| JP | 06-199469 | 7/1994 |
| JP | 10-175751 | 6/1998 |
| JP | 2001-175118 | 6/2001 |
| JP | 2003-306251 | 10/2003 |
| JP | 2006-163039 | 6/2006 |

OTHER PUBLICATIONS

Japanese Office Action for Application No. 2008-028543 mailed on May 18, 2010.
Office Action for corresponding Japanese Patent Application 2008-028543 mailed on Dec. 22, 2009.

* cited by examiner

*Primary Examiner* — David Gray
*Assistant Examiner* — Laura Roth
(74) *Attorney, Agent, or Firm* — Banner & Witcoff, Ltd.

(57) ABSTRACT

An image-forming device, such as a laser printer, includes a sheet-feed section, an image-forming section, a thermal fixing section and a control section. The sheet-feed section is configured to feed a recording sheet to a conveyance path. The image-forming section is disposed along the conveyance path and configured to form a toner image on the recording sheet. The thermal fixing section is disposed downstream of the image-forming section in a direction of sheet feeding and configured to fix the toner image on the recording sheet with a predetermined temperature. The control section is configured to control the temperature of the thermal fixing section, to detect a sheet-feed error in the sheet-feed section and to output an error signal indicative of the error occurring. The control section may further be configured to change the temperature of the thermal fixing section in response to the error signal.

9 Claims, 7 Drawing Sheets

IMAGE-FORMING DEVICE FOR SUPPRESSING INTERNAL TEMPERATURE RISE WHEN SHEET-FEED ERROR OCCURS

CROSS REFERENCE TO RELATED APPLICATION

This application claims priority from Japanese Patent Application No. 2008-028543 filed Feb. 8, 2008. The entire content of the priority application is incorporated herein by reference.

BACKGROUND OF THE INVENTION

1. Field of the Invention

The present invention relates to image-forming devices, and more particularly to an image-forming device capable of suppressing internal temperature rise in the event when sheet-feed errors occur.

2. Description of the Related Art

Conventionally, image-forming devices operated under an electrophotographic technology include a sheet cassette for accommodating sheets of paper, a sheet-feed roller, a pair of registration rollers and the like. When an image forming operation is performed, the sheet-feed roller is driven to feed the uppermost sheet stacked on the sheet-feed cassette into a sheet conveyance path. The sheet of paper thus fed is subject to registration by the pair of registration rollers disposed behind an image-forming section. That is, the leading edge of the sheet of paper is brought into alignment with the nip portion between the pair of registration rollers. The sheet of paper once subject to registration is further conveyed toward the image-forming section by the registration rollers and the sheet-feed roller. The image-forming section forms an image on the sheet of paper.

Despite the sheet-feed roller being driven properly, the sheet may accidentally be caught by the sheet-feed cassette, disabling the sheet to normally feed. To solve such a problem, Japanese Patent Application Publication No. 6-199469 proposes disposing a sheet-feed sensor in a prescribed position between the sheet-feed roller and the registration rollers for sensing a leading edge of the sheet. When a measured conveyance time T1 is longer than a preset sheet conveyance time T, then it is determined that the sheet-feed error has occurred. When it is the case, an image-forming section halts an image-forming operation and a control section advises the operator to clean the sheet-feed roller.

To perform an image fixing operation on the sheet of paper, the temperature of a heat roller in a thermal fixing section has to be increased up to a predetermined target temperature to thermally fix a toner image on the sheet of paper. Passing the sheet of paper through the thermal fixing section dissipates the heat in the heat roller, causing the temperature of the heat roller to lower. Typically, a temperature sensor is provided in the heat roller. If the temperature sensor indicates that the temperature of the heat roller has increased and exceeded the target temperature, the temperature of the heat roller is lowered to the target temperature.

The temperature of the heat roller starts increasing immediately after the sheet-feed error has occurred because the heat in the heat roller is not dissipated by the sheet of paper passing through the thermal fixing section, resulting in an increase in the internal temperature of the image-forming device. At this time, the temperature sensor senses the temperature rise of the heat roller. However, the temperature sensors are generally incapable of providing a real time temperature output but a brief period of time is needed to reflect the current temperature of the heat roller in the output of the sensor. As such, a problem arises such that the temperature of the heat roller temporarily increases immediately after the sheet-feed error has occurred and accordingly the internal temperature of the image-forming device increases. Another problem is that the increase in the internal temperature of the image-forming device excessively warms up and curls the subsequently fed sheet of paper.

SUMMARY OF THE INVENTION

In view of the foregoing, it is an object of the present invention to provide an image-forming device capable of suppressing increase in surface temperature of a heat roller when a sheet-feed error has occurred and preventing the internal temperature of the image-forming device from overly increasing.

In order to achieve the above and other objects, there is provided An image-forming device that includes a sheet-feed section, an image-forming section, a thermal fixing section, a control section, and a sheet-feed error detecting section. The sheet-feed section is configured to feed a sheet of paper to a sheet conveyance path. The image-forming section is disposed along the sheet conveyance path and configured to form a toner image on the sheet of paper. The thermal fixing section is disposed downstream of the image-forming section with respect to a direction in which the sheet of paper is fed and configured to thermally fix the toner image on the sheet of paper with a predetermined temperature. The control section is configured to control temperature of the thermal fixing section. The sheet-feed error detecting section detects a sheet-feed error which may occur in the sheet-feed section and outputs an error detection signal indicative of occurrence of the sheet-feed error. The control section changes the temperature of the thermal fixing section in response to the error detection signal.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENTS

Figure 1:
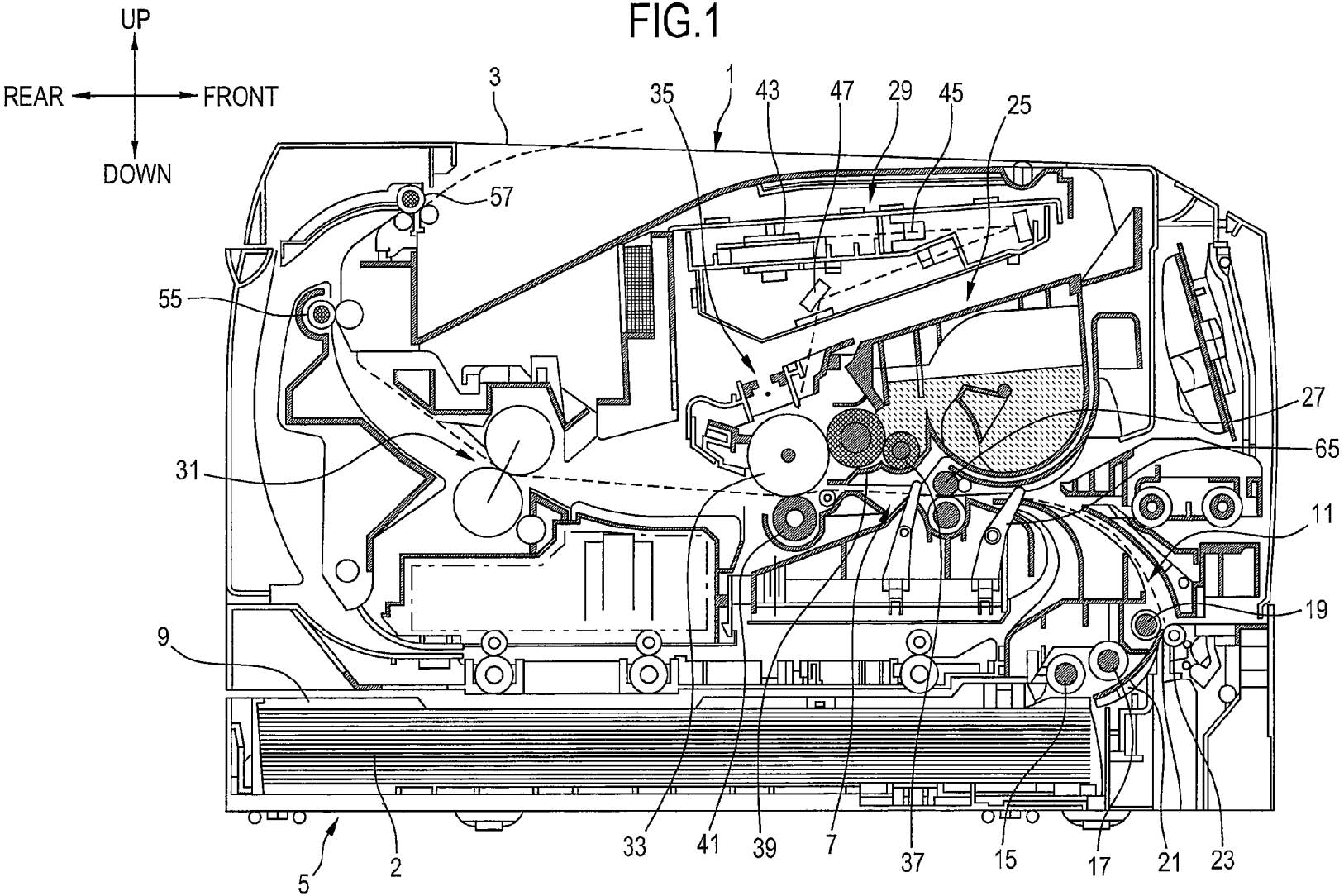
FIG. 1 is a vertical cross-sectional view showing a laser printer according to an embodiment of the invention.

An embodiment of the present invention will be described with reference to the accompanying drawings. FIG. 1 is a vertical cross-sectional view showing a laser printer 1. The laser printer 1 is exemplified herein as one of image-forming devices to which the present invention pertains. In the following description, the terms "up", "down" "front", "rear" and the like will be used throughout the description assuming that the laser printer 1 is disposed in an orientation as shown in FIG. 1.

The laser printer 1 includes a body casing 3, a feeder 5 serving as a sheet-feed section for feeding sheets of paper 2, and an image-forming section 7 for forming images on the sheets of paper 2.

The feeder 5 includes a sheet-feed cassette 9 and rollers for feeding a sheet of paper one at a time. Sheet-feed roller 15, separation roller 17, and backup roller 19 are disposed in the stated order inside and in the front side of the sheet-feed cassette 9. These rollers are disposed along a sheet conveyance path. Each roller extends in the widthwise direction of the sheet-feed cassette 9 (that is, in the direction orthogonal to the sheet of drawing) and has a rotational shaft rotatably supported by the body casing 3. The separation roller 17 and a separation pad 21 are disposed in contact with each other, and a paper dust removing roller 23 and the backup roller 19 are also disposed in contact with each other.

The separation pad 21 is urged against the separation roller 17 by a coil spring (not shown). Plural sheets of paper are not fed into the conveyance path 11 in a stacked state due to frictional force generated between the separation roller 17 and the uppermost sheet.

The feeder 5 is provided with a motor 69 (see FIG. 3) that is driven under the aegis of a CPU (described later). Driving torque created by the motor 69 is transmitted by power transmission gears (not shown) to the sheet-feed roller 15, separation roller 17 and the backup roller 19 to rotate these rollers.

In FIG. 1, the sheet conveyance path 11 is depicted by a dotted line. A starting part of the sheet conveyance path is defined by the sheet-feed roller 15, separation roller 17, backup roller 19, and the paper dust removing roller 23. The sheet conveyance path 11 is smoothly upwardly curved to turn around at a position close to the sheet dust removing roller 23. The sheet conveyance path 11 extends toward the rear side of the laser printer 1. The sheet conveyance path 11 is then smoothly upwardly curved to turn around at a position close to a discharge roller 55 disposed at the rear side of the laser printer 1. The sheet conveyance path 11 further extends obliquely upwardly up to a sheet receiving tray formed at the top face of the laser printer 1. Beneath a process cartridge 25, a pair of registration rollers 27 is disposed.

With the rollers disposed along the sheet conveyance path and the driving force of the motor 69 applied to the rollers, the sheet of paper 2 is conveyed along the sheet conveyance path 11 and introduced into the image-forming section 7 after registration by the pair of registration rollers 27.

The image-forming section 7 includes a scanner section 29, and the process cartridge 25. The scanner section 29 is disposed in the upper portion of the body casing 3 and includes a laser emitting section (not shown), a polygon mirror 43, a lens 45, and a reflection mirror 47. Laser beam is emitted from the laser emitting section based on image data and transmitted through or reflected on the polygon mirror 43, lens 45, reflection mirror 47 as shown by a dotted line in FIG. 1. The laser beam is then scanned at a high speed on the surface of a photosensitive drum 33 serving as an image carrying member provided inside the process cartridge 35.

The process cartridge 25 is disposed beneath the scanner section 29 and is detachably mounted on the body casing 3. The process cartridge 25 includes the photosensitive drum 33, a charger 35, a toner supply roller 37, a developer roller 39, and a toner container for storing toner serving as a developing agent. Rotations of the toner supply roller 37 convey the toner onto the surface of the developer roller 39. The developer roller 39 transfers the toner onto the surface of the photosensitive drum 33 on which an electrostatic latent image is formed. The photosensitive drum 33 is rotatably disposed in confronting relation with the developer roller 39 and is electrically grounded. The photosensitive drum 33 has a photosensitive layer made from, for example, polycarbonate, on its peripheral surface and showing a positively chargeable characteristic.

As the photosensitive drum 33 rotates, its peripheral surface is uniformly charged by the charger 35 disposed above the photosensitive drum 33. When the photosensitive drum 33 further rotates, the peripheral surface of the photosensitive drum 33 is exposed to laser beam scanned in the axial direction of the photosensitive drum 33. The laser beam is modulated by the image data, so that an electrostatic latent image formed on the surface of the photosensitive drum 33 corresponds to the image data. Charges on the areas of the photosensitive drum 33 where the latent image is formed are discharged to ground. When the photosensitive drum 33 further rotates, positively charged toner carried on the surface of the developer roller 39 is transferred onto the exposed regions on the photosensitive drum 33, thereby achieving a discharged area development in which the latent image is developed into a visible image.

The transfer roller 41 is disposed beneath the photosensitive drum 33 and rotatably supported on the body casing 3. The transfer roller 41 has a peripheral surface in contact with the peripheral surface of the photosensitive drum 33. The transfer roller 41 is configured from a metal shaft around which an electrically conductive rubber is covered to form a roller portion. A predetermined transfer bias determined relative to the potential of the photosensitive drum 33 is applied to the transfer roller 41. Due to the transfer bias applied thereto, the toner image on the surface of the photosensitive drum 33 is transferred to a sheet of paper 2 when it passes between the photosensitive drum 33 and the transfer roller 41.

Figure 2:
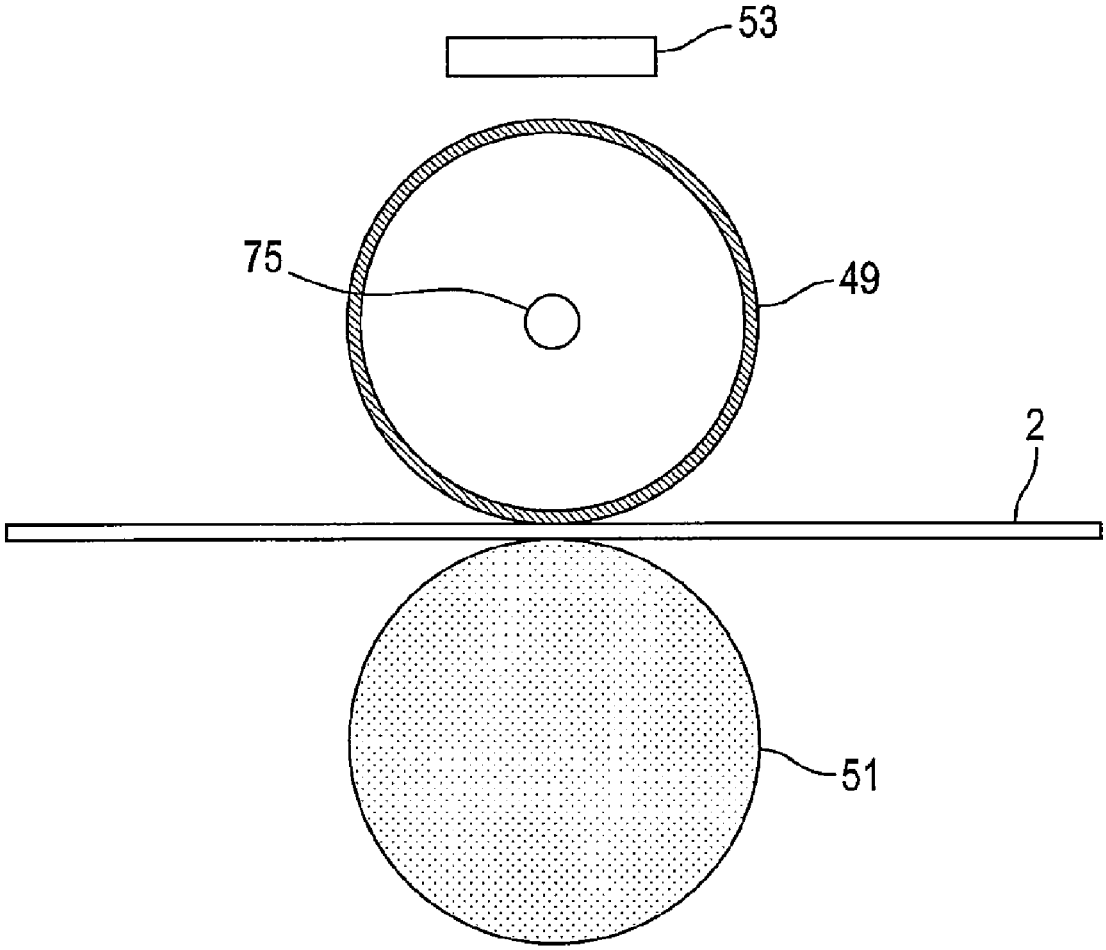
FIG. 2 is a partial cross-sectional view showing a thermal fixing section provided in the laser printer shown in FIG. 1.

A thermal fixing section 31 is disposed downstream of the process cartridge 25 with respect to the direction in which the sheet of paper 2 is conveyed. FIG. 2 is a vertical cross-sectional view showing the central portion of the thermal fixing section 31. The thermal fixing section 31 has a housing (not shown) fixed to inside of the body casing 3. The housing of the thermal fixing section 31 is made from an electrically insulating material. Both the heat roller 49 and the pressure roller 51 are rotatably supported on the housing of the thermal fixing section 31. A non-contact type thermistor 53 is disposed above the heat roller 49 for detecting the temperature of the heat roller 49.

The non-contact type thermistor 53 is fixed to the housing of the thermal fixing section 31 and separated from the heat roller 49 to an extent that the temperature of the heat roller 49 can be detected. While the non-contact type thermistor 53 is employed in this embodiment, a contact type thermistor can be used instead. The contact type thermistor is positioned to contact the heat roller 49.

The heat roller 49 is made from a metal and is in the form of a cylindrical shape with a heater 75 provided inside. At least the surface portion of the pressure roller 51 is made from a resilient material, such as rubber. Alternatively, the surface portion of the heat roller 49 may be made of a resilient material and the surface portion of the pressure roller 51 may be made of a rigid material, such as a metal. The heat roller 49 is rotated by a motor (not shown) disposed in the body casing 3. The vertically arranged heat roller 49 and the pressure roller 51 are in pressure contact with each other and a sheet of paper 2 is nipped between and conveyed by these two rollers. The toner image transferred onto the sheet of paper 2 is thermally fixed thereon while passing a nip between the heat roller 49 and the pressure roller 51. In modification, an endless belt may be employed in place of at least one of the heat roller 49 and pressure roller 51. The endless belt serves as a means for applying heat and/or pressure to the sheet of paper on which the toner image is formed.

The sheet of paper 2 with the thermally fixed toner image thereon is nipped by the discharge roller 55 disposed downstream of the heat roller 49 and the pressure roller 51 and further conveyed to downstream. Then, the sheet of paper 2 is discharged outside the body casing 3 with the aid of a pair of feed rollers 57 (se FIG. 1) disposed above the body casing 3.

It should be noted that although a monochromatic laser printer 1 has been described as an embodiment of the invention, the present invention is also applicable to a color laser printer, an LED printer or the like.

Figure 3:
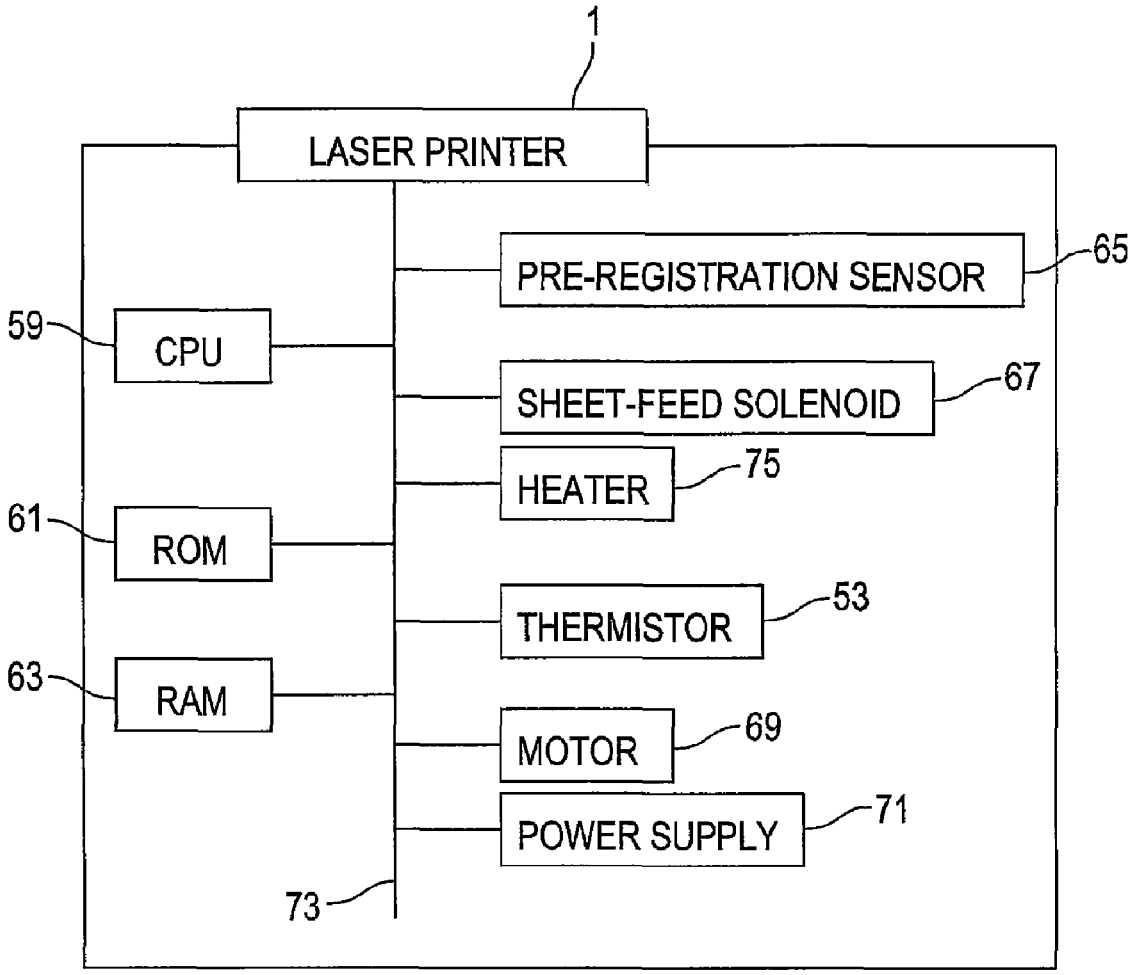
FIG. 3 is block diagram showing a hardware arrangement of the laser printer shown in FIG. 1.

Next, a hardware arrangement of the laser printer 1 will be described with reference to FIG. 3. As shown, the laser printer 1 includes the CPU 59, ROM 61, RAM 63, pre-registration sensor 65, sheet-feed solenoid 67, heater 75, thermistor 53, motor 69, and power supply 71, which are mutually connected to one another to allow control signals to be inputted or outputted through a bus 73.

The ROM 61 stores execution programs used for operating the laser printer 1. The CPU 59 controls various parts of the laser printer 1 through a control circuit in accordance with the programs retrieved from the ROM 61 and stores the processed results in the RAM 53.

As shown in FIG. 1, the pre-registration sensor 65 is disposed upstream of the registration rollers 27. The pre-registration sensor 65 optically or mechanically detect the leading edge of a sheet of paper 2 conveyed along the sheet conveyance path 11. Specifically, the pre-registration sensor 65 outputs a detection signal to the CPU 59 when the sensor 65 is changed from a state in which the sheet is detected (ON state) to a state in which the sheet is not detected (OFF state).

The sheet-feed solenoid 67 carries out a sheet-feed operation when a sheet-feed clutch (not shown) is actuated. The sheet-feed clutch is provided to transmit rotations of the motor 69 to the sheet-feed roller 15. More specifically, in response to the sheet-feed commands issued from the CPU 59, the sheet-feed clutch is actuated. Then, the rotations of the motor 69 are transmitted to the sheet-feed roller 15 via a power transmission gear, causing a sheet of paper 2 to feed into the image-forming section 7.

The heater 75 is disposed interiorly of the cylindrically-shaped heat roller 49 and generates heat when energized by a power supply 71. The heat roller 49 is warmed up by the heat generated from the heater 75. Power supplied to the heater 75 is controlled through a control circuit in response to a control signal issued from the CPU 59. The thermistor 53 detects the temperature of the heat roller 49 and a detection signal output from the thermistor 53 is applied to the CPU 59. Based on the detection signal, the CPU 59 controls power supply to the heater 75 through the control circuit.

A plurality of motors similar to the one used in the feeder 5 is provided in various sections in the laser printer 1. These motors are also controlled by the control circuit in response to commands issued from the CPU 59.

The laser printer 1 is powered by the power supply 71 which is controlled in response to control signals from the CPU 59.

Figure 4:
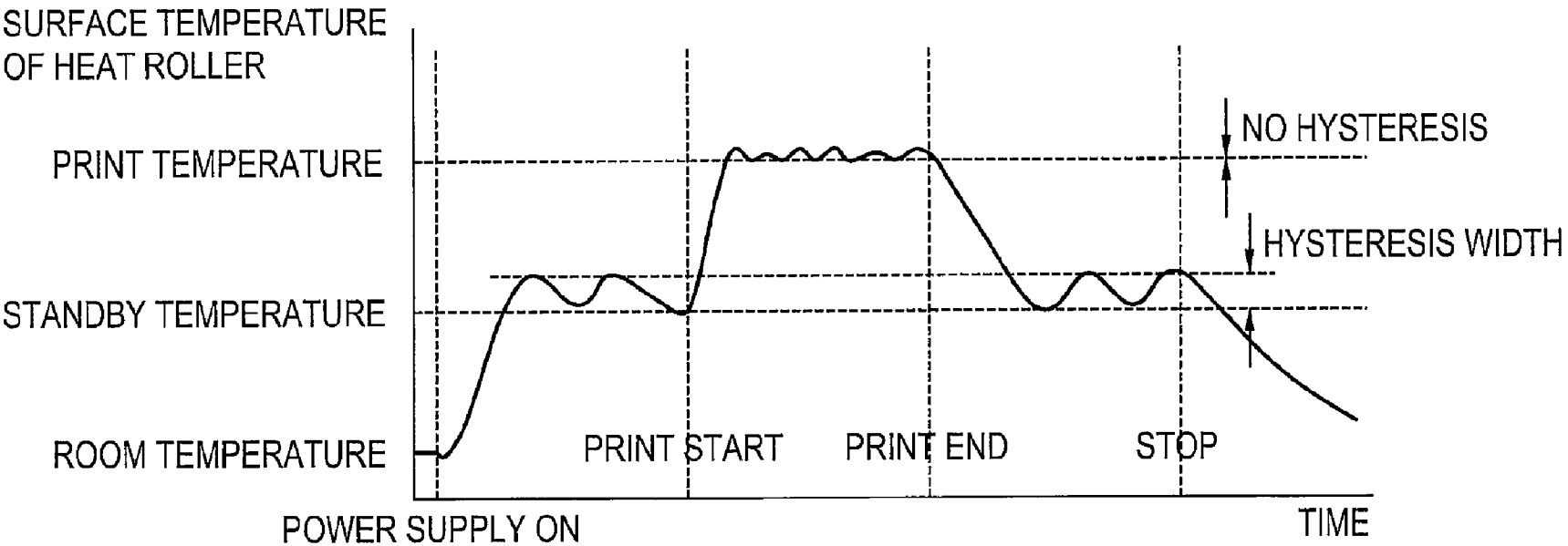
FIG. 4 is a graphical representation showing temperature changes on the surface of a heat roller from time at which the laser printer is powered to time at which until the laser printer is placed in a stand-by mode.
Figure 5:
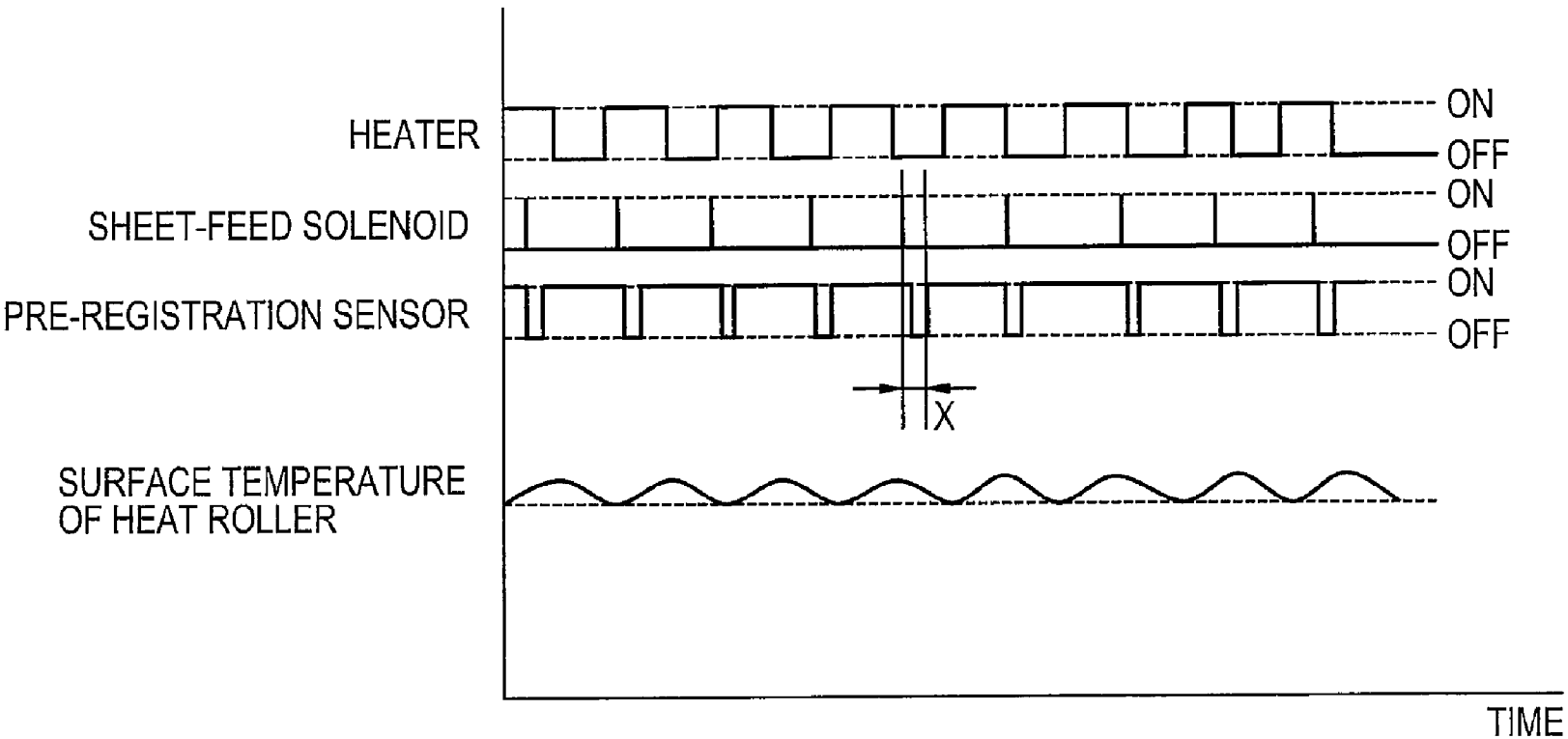
FIG. 5 is a timing chart illustrating operation timings of heater, sheet-feed solenoid, and pre-registration sensor.

Next, while referring to FIGS. 4 and 5, description will be made with respect to temperature control of the heat roller 49 performed under the continuous printing. The temperature control is executed by the CPU 59 based on a control program stored in the ROM 61. FIG. 4 shows change in surface temperature of the heat roller 49 from a time at which the laser printer 1 is powered on to a time at which the laser printer 1 is placed in a standby mode. In the graph of FIG. 4, the axis of abscissas indicates time and the axis of ordinates the surface temperature of the heat roller 49. FIG. 5 shows a timing chart of the heater 75, sheet-feed solenoid 67, and pre-registration sensor 65.

Referring to FIG. 4, the internal temperature of the laser printer 1 is almost equal to room temperature when the power supply 71 of the laser printer 1 is kept in an off state (initial state). In the following description, the term "standby temperature" will be used to mean a temperature set to the surface of the heat roller 49 when the power supply 71 of the laser printer 1 is turned on and the print commands have not yet issued from the CPU 59. In this embodiment, when the print commands are not issued, the surface temperature of the heat roller 49 is controlled to fall within a fixed range called hysteresis width. The upper limit of the hysteresis width is about 15° C. higher than the standby temperature.

In the following description, the term "print temperature" will be used to mean a set value of the surface temperature of the heat roller 49 under a printing operation performed in response to the print commands. A hysteresis width is not given to the print temperature. Power to the heater 75 is controlled so that the surface temperature of the heat roller 49 is maintained at the print temperature if the surface temperature of the heat roller 49 detected by the thermistor 53 changes from the print temperature. The standby temperature is set lower than the print temperature. The print temperature, standby temperature and its hysteresis width have been stored in the ROM 61 beforehand. Such data stored in the ROM 61 is retrieved and temporarily stored in the RAM 63 and relevant values for the print temperature, standby temperature and its hysteresis width are set depending on the property of the laser printer 1.

When the power supply 71 is turned on, heater 75 is supplied with power therefrom. Generation of heat from the heater 75 warms up the heat roller 49 and the thermistor 53 provides a temperature detection signal indicative of the surface temperature of the heat roller 53. The surface temperature of the heat roller 53 is controlled to fall within the hysteresis range of the standby temperature before the print commands are issued. Feeding electric power to the heater 75 may be halted and the laser printer 1 may be placed in a standby mode at the room temperature if the print commands are not issued for a prescribed period of time.

Issuance of the print commands causes the heater 75 to generate heat and hence the surface temperature of the heat roller 49 increases. When the surface temperature has increased to the print temperature ready for printing, the sheet-feed solenoid 67 is turned on or energized (see FIG. 5), thereby commencing the sheet-feed operation. The sheet of paper 2 passes through the sheet conveyance path 11 and the pre-registration sensor 65 is turned on when the leading edge of the sheet of paper 2 is detected by the sensor 65. In the following description, the term "standard conveyance time X" (unit: second) will be used to mean a duration of time from a time at which the sheet-feed solenoid 67 is turned on to a time at which the pre-registration sensor 65 is turned on. The standard conveyance time X is computed by dividing the length L of the corresponding sheet conveyance path with conveyance speed V of the sheet of paper 2, i.e., $X=L/V$. The thus computed standard conveyance time X is stored in the ROM 61 beforehand. It should be noted that the conveyance speed V takes different values depending upon the type and specification of the laser printers.

The sheet of paper 2 passes through the image-forming section 7 where a toner image is transferred on the sheet of paper 2, and then is introduced into the thermal fixing section 31 where the sheet of paper 2 is fed into a gap between the heat roller 49 and the pressure roller 51. The toner image on the sheet of paper 2 is thermally fixed by the heat of the heat roller 49. At this time, the surface temperature of the heat roller 49 is lowered as the heat is transferred to the sheet of paper. When the surface temperature of the heat roller 49 becomes lower than the print temperature, the heater 75 is controlled to increase the surface temperature of the heat roller 49 to recover the print temperature. In the case of continuous printing, the surface temperature of the hear roller 49 is again lowered when the subsequently fed sheet of paper 2 passes through the thermal fixing section 31. That is, the temperature decrease on the surface of the heat roller 49 occurs repeatedly every time when the sheet of paper passes through the gap between the heat roller 49 and the pressure roller 51. The change in the surface temperature of the heat roller 49 is shown in FIGS. 4 and 5 where the axis of abscissas indicates time.

When the printing operation ends, the surface temperature of the heat roller 49 is again set to the standby temperature. To this end, power supply to the heater 75 is controlled so that the temperature of the heat roller 49 is brought equal or nearly equal to the standby temperature. In the absence of the print commands for a predetermined period of time, the laser printer 1 is shifted to a sleep mode in which the power supply to the heater 75 is stopped and the internal temperature of the laser printer 1 becomes equal to the room temperature.

Referring to the flowchart in FIG. 6 and the timing chart in FIG. 7, a temperature control of the heat roller 49 will be described. This control is executed when the sheet-feed error is detected during continuous printing. The CPU 59 executes the temperature control based on a control program stored in the ROM 61.

Figure 6:
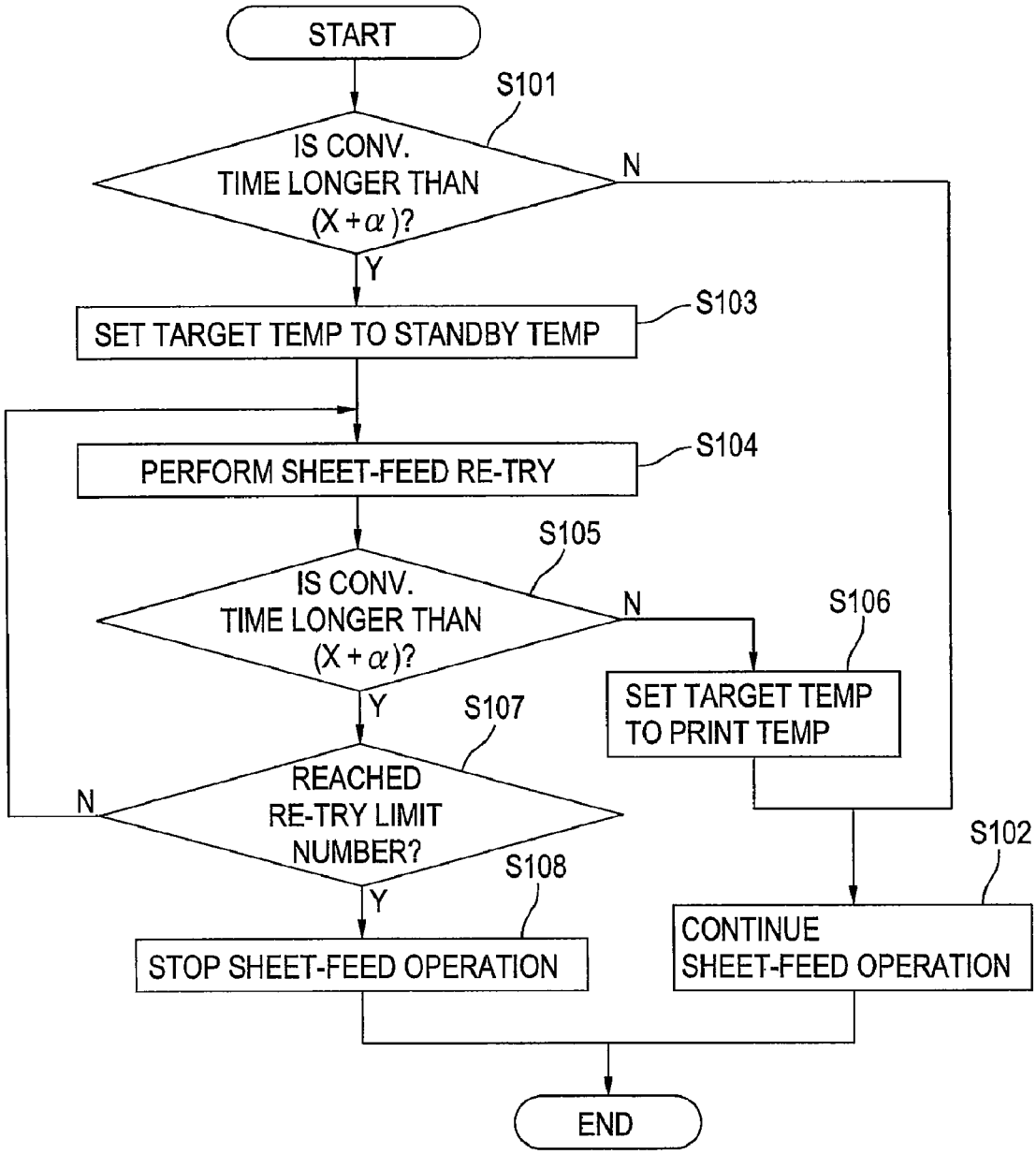
FIG. 6 is a flowchart illustrating a temperature control process to be executed when a sheet-feed error has occurred during continuous printing.
Figure 7:
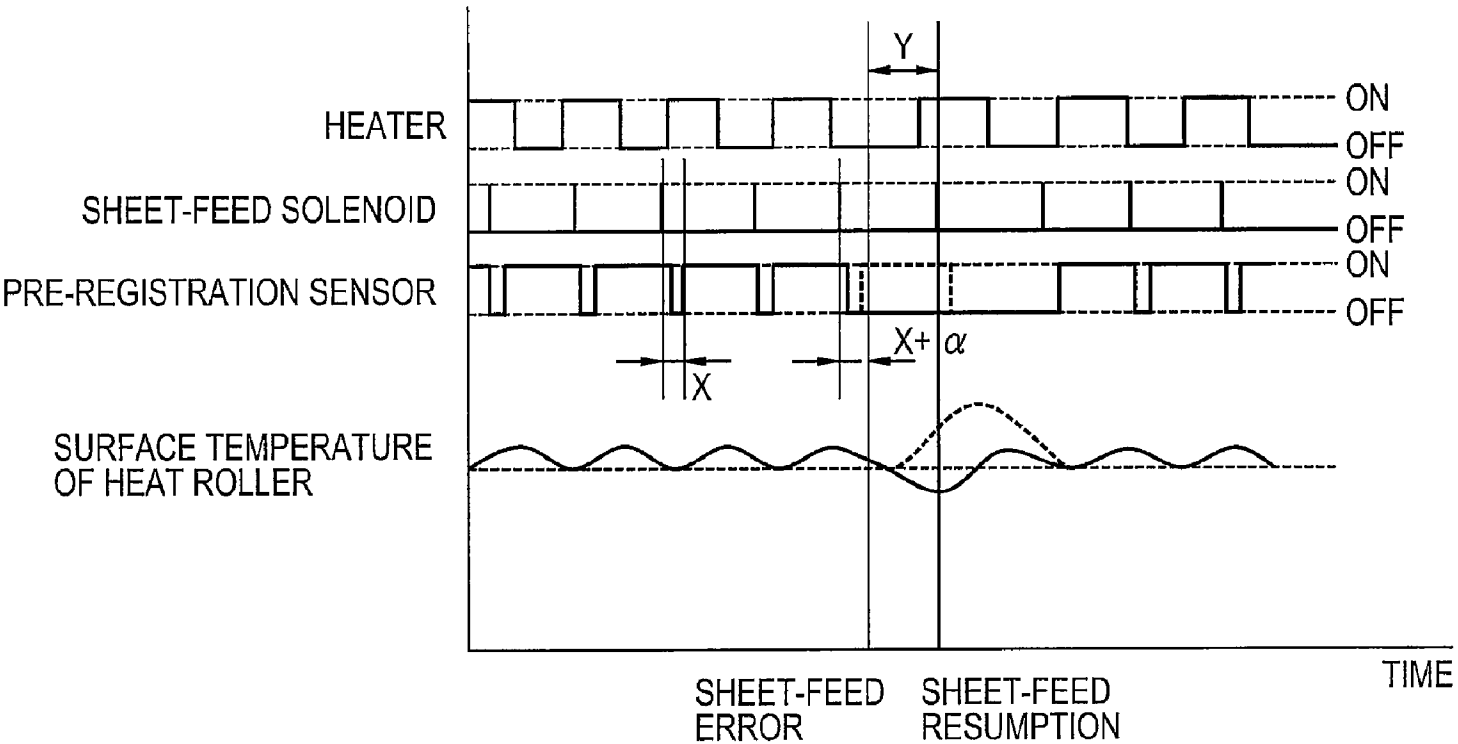
FIG. 7 is a timing chart illustrating operation timings of heater, sheet-feed solenoid, and pre-registration sensor when the sheet-feed error has occurred during continuous printing.

Before the start of execution of the flowchart shown in FIG. 6, the print commands have been issued in accordance with the user operation and the sheet-feed solenoid 67 has been placed in ON state under the aegis of the CPU 59. In S101, determination is made as to whether or not the time duration from when the sheet-feed operation has commenced to when the pre-registration sensor 65 has turned on is equal to or longer than a criteria for determining that sheet-feed error has occurred. More specifically, the threshold value ($X+\alpha$) stored in the ROM 61 and temporarily written in the RAM 63 is retrieved from the RAM 63. Then, measurement of a conveyance time is performed from when the sheet-feed solenoid 67 is turned on to when the leading edge of the sheet of paper 2 is detected by the pre-registration sensor 65. Whether the measured conveyance time has exceeded the threshold value is determined.

Time duration Y is herein defined to mean duration of time from when determination of occurrence of the sheet-feed error is made to when sheet-feed re-try is commenced. As shown in FIG. 7, $\alpha$ takes a value smaller than ($Y-X$). The reason for defining the threshold value as a sum of the standard conveyance time X and the value $\alpha$ is that the threshold value should not be smaller than the standard conveyance time X defined from when the sheet-feed solenoid is actually turned on to when the pre-registration sensor 65 is turned on.

In S101, when it is determined that the conveyance time from when the sheet-feed solenoid 67 is turned on and thus the sheet-feed operation is commenced to when the pre-registration sensor 65 is turned on is not longer than the threshold value ($X+\alpha$) (S101: NO), the CPU 59 judges that the sheet-feed operation is normally performed, whereupon the routine proceeds to S102. In S102, the sheet-feed operation is continuously performed and the process is ended upon completion of the sheet-feed operation. On the other hand, when it is determined that the conveyance time from when the sheet-feed operation is commenced to when the leading edge of the sheet of paper 2 is detected by the pre-registration is longer than the threshold value ($X+\alpha$) (S101: YES), the CPU 59 judges that the sheet-feed error has occurred, whereupon the routine proceeds to S103. In S103, a target temperature is set so that the surface temperature of the heat roller 49 is in coincidence with the standby temperature. In actual settings, the standby temperature as stored in the ROM 62 is retrieved and stored in the RAM 63.

After completion of the process in S103, the routine proceeds to S104 where sheet-feed re-try is performed. The sheet-feed re-try means to challenge the sheet-feed operation again. The operation of the sheet-feed re-try is the same as the initially performed sheet-feed operation. When the sheet-feed re-try is performed, the routine proceeds to S105. In S105, it is determined that the conveyance time from when the sheet-feed operation is commenced to when the pre-registration sensor 65 is turned on is longer than the threshold value for determining that the sheet-feed error has occurred. The process executed in S105 is the same as that executed in S101. The threshold value used in S105 is also the same as that used in S101.

In S105, when it is determined that the conveyance time from when the sheet-feed re-try operation is commenced to when the pre-registration sensor 65 is turned on is not longer than the threshold value ($X+\alpha$) (S105: NO), the CPU 59 judges that the sheet-feed operation is normally performed at this time, whereupon the routine proceeds to S106. In S106, a target temperature is reset so that the surface temperature of the heat roller 49 is in coincidence with the standby temperature. In actual settings, the standby temperature as stored in the ROM 62 is retrieved and written into the RAM 63. Upon completion of resetting the target temperature, the routine proceeds to S102 where the sheet-feed operation is continued and thereafter the process is ended.

On the other hand, when it is determined that the conveyance time from when the sheet-feed re-try operation is commenced to when the leading edge of the sheet of paper 2 is detected by the pre-registration sensor 65 is longer than the threshold value ($X+\alpha$) (S105: YES), the CPU 59 judges that the sheet-feed error has again occurred, whereupon the routine proceeds to S107. In S107, the number of times the sheet-feed errors have occurred since the commencement of the sheet-feed re-try operation is counted and determination is made as to whether the counted number has reached a sheet-feed re-try limit number. Both the counter number and the sheet-feed re-try limit number are stored in the RAM 63. The specific value for the sheet-feed re-try limit number is set while taking the property and/or other matters specific to the laser printer 1.

When the counted number has not yet reached the sheet-feed re-try limit number (S107: NO), the routine returns to S104 where the sheet-feed re-try operation is continued. When the counted number has reached the sheet-feed re-try limit number (S107: YES), the routine proceeds to S108. In S108, the sheet-feed solenoid 67 is de-energized to thereby stop the sheet-feed operation, whereupon the process shown in FIG. 6 is ended. At the end of the process, the number of times the sheet-feed errors have occurred and the conveyance time as stored in the RAM 63 are cleared.

As described above, when the sheet-feed error is detected, the surface temperature of the heat roller 75 is set to the standby temperature, to thereby lower the surface temperature of the heat roller 49. Dotted line indicating the change in the surface temperature of the heat roller 49 indicates the case in which the target temperature of the heat roller 49 is not reset notwithstanding the fact that the sheet-feed error has occurred. When the sheet-feed error occurs, a sheet of paper 2 does not pass through the thermal fixing section 31, the heat accumulated in the heat roller 49 is not dissipated. Accordingly, the time delay in fining the change in the surface temperature of the heat roller 49 with the thermistor 53 causes the control of the heater 75 to delay. As a result, actual surface temperature of the hear roller 49 is higher than the temperature as detected by the thermistor 53, resulting in temporary temperature rise in the interior of the laser printer 1.

According to the embodiment of the invention as described above, when the occurrence of the sheet-feed error is detected, the target temperature is set to the standby temperature. Accordingly, as shown in th the solid line in FIG. 7, the temperature rise on the surface of the heat roller 49 can be prevented and thus the temperature rise in the interior of the laser printer 1 can be prevented. Due to substantial no temperature rise in the interior of the laser printer at the time of occurrence of the sheet-feed error, the subsequently fed sheet of paper is not unduly warmed up, preventing the sheet from being overly curled. Further, not only can the temperature rise in the interior of the laser printer 1 be prevented but also occurrence of a sheet-feed jam can be detected by counting the number of times the sheet-feed errors have occurred and stopping the sheet-feed try when the counted number of the sheet-feed errors has reached the predetermined limit number.

Although the present invention has been described with respect to a specific embodiment, it will be appreciated by one skilled in the art that a variety of changes and modifications may be made without departing from the scope of the invention. For example, in the embodiment described above, the target temperature is set to the standby temperature in S103 of the flowchart shown in FIG. 6, but the target temperature may not be changed as described. Instead, the heater 75 may be forcibly turned off to interrupt the supply of power thereto. Further, in the embodiment described above, the measurement of the conveyance time of the sheet of paper is carried out by the use of sheet-feed solenoid and the pre-registration sensor but other types of sensors can be employed instead insofar as the conveyance time of the sheet of paper can be employed.

What is claimed is:

1. An image-forming device comprising:

a sheet-feed section configured to feed a sheet of paper to a sheet conveyance path;

an image-forming section disposed along the sheet conveyance path and configured to form a toner image on the sheet of paper;

a thermal fixing section disposed downstream of the image-forming section with respect to a direction in which the sheet of paper is fed, wherein the thermal fixing section is configured to thermally fix the toner image on the sheet of paper with a predetermined temperature; and a control section configured to:

control temperature of the thermal fixing section, detect a sheet-feed error occurring in the sheet-feed section, output an error detection signal indicative of an occurrence of the sheet-feed error, change the temperature of the thermal fixing section in response to the error detection signal, wherein the control section is further configured to:

store a number of times the sheet-feed error occurred in a sheet-feed error occurrence times storing section, determine that the number of times stored in the sheet-feed error occurrence times storing section has reached a predetermined number of times, and halt sheet feeding by the sheet-feed section in response to determining that the number of times stored in the sheet-feed error occurrence times storing section has reached the predetermined number of times.

2. The image-forming device according to claim 1, further comprising:

a sheet detecting section configured to detect the sheet of paper fed from the sheet-feed section; and wherein the control section is further configured to:

measure a conveyance time of the sheet of paper from a time at which a sheet-feed operation is commenced by the sheet-feed section to a time at which the sheet of paper is detected by the sheet-detecting section, determine that the sheet-feed error has occurred when the measured conveyance time is longer than a first predetermined threshold value.

3. The image-forming device according to claim 2, wherein the sheet-feed section comprises a sheet-feed roller and a sheet-feed solenoid that actuates the sheet-feed roller to move the sheet of paper into the sheet conveyance path.

4. The image-forming device according to claim 3, further comprising a pair of registration rollers disposed upstream of the image-forming section with respect to the direction in which the sheet of paper is fed, wherein the sheet detecting section is disposed further upstream of the pair of registration rollers.

5. The image-forming device according to claim 4, wherein the thermal fixing section comprises a heat roller and a pressure roller in pressure contact with the heat roller.

6. The image-forming device according to claim 5, wherein the control section is configured to change a surface temperature of the heat roller when a time duration from a time at which the sheet-feed solenoid is actuated to a time at which the sheet detecting section detects the sheet of paper is longer than a second predetermined threshold value.

7. The image-forming device according to claim 1, wherein the control section is configured to control the thermal fixing section to decrease the temperature of the thermal fixing section to be lower than the predetermined temperature in response to the error detection signal.

8. The image-forming device according to claim 1, wherein the control section is configured to control the thermal fixing section to decrease the temperature of the thermal fixing section to a temperature falling within a predetermined range in response to the error detection signal.

9. The image-forming device according to claim 1, wherein the control section is configured to interrupt a supply of electrical power to the thermal-fixing section in response to the error detection signal.

* * * * *